US008662817B2

(12) United States Patent
Daraie et al.

(10) Patent No.: US 8,662,817 B2
(45) Date of Patent: Mar. 4, 2014

(54) COUPLER WITH SAFETY CAM

(75) Inventors: Shadruz Daraie, Fairlawn, OH (US); Robert Sikorski, Stow, OH (US)

(73) Assignee: Paladin Brands Group, Inc., Oak Brook, IL (US)

( * ) Notice: Subject to any disclaimer, the term of this patent is extended or adjusted under 35 U.S.C. 154(b) by 978 days.

(21) Appl. No.: 12/683,762

(22) Filed: Jan. 7, 2010

(65) Prior Publication Data

US 2010/0172732 A1 Jul. 8, 2010

Related U.S. Application Data

(60) Provisional application No. 61/143,366, filed on Jan. 8, 2009.

(51) Int. Cl.
*B66C 23/00* (2006.01)
*E02F 3/36* (2006.01)
*E02F 3/96* (2006.01)

(52) U.S. Cl.
USPC ..... 414/723; 37/468; 172/272

(58) Field of Classification Search
USPC ..... 414/723; 403/321; 172/272–275; 37/468
See application file for complete search history.

(56) References Cited

U.S. PATENT DOCUMENTS

| | | | |
|---|---|---|---|
| 5,549,440 | A | 8/1996 | Cholakon et al. |
| 5,692,325 | A | 12/1997 | Kuzutani |
| 5,890,871 | A | 4/1999 | Woerman |
| 6,132,131 | A | 10/2000 | Nakamura et al. |
| 6,422,805 | B1 | 7/2002 | Miller |
| 6,431,785 | B1 | 8/2002 | Melander |
| 6,481,124 | B1 | 11/2002 | Miller et al. |
| 6,508,616 | B2 | 1/2003 | Hung |
| 6,691,438 | B2 | 2/2004 | Fatemi |
| 6,699,001 | B2 | 3/2004 | Fatemi |
| 6,881,002 | B2 | 4/2005 | Fatemi |
| 6,902,346 | B2 | 6/2005 | Steig, Jr. et al. |
| 6,962,475 | B2 | 11/2005 | Fatemi |
| 6,964,122 | B2 | 11/2005 | Cunningham et al. |
| 7,306,395 | B2 | 12/2007 | Fatemi |
| 7,426,796 | B2 | 9/2008 | Cunningham et al. |
| 2007/0157492 | A1 | 7/2007 | Miller et al. |
| 2007/0166143 | A1 | 7/2007 | Hart et al. |
| 2008/0067784 | A1 | 3/2008 | Calvert et al. |

FOREIGN PATENT DOCUMENTS

| | | |
|---|---|---|
| WO | WO 2008/029112 | 3/2008 |

*Primary Examiner* — Scott Lowe
(74) *Attorney, Agent, or Firm* — Fay Sharpe LLP

(57) ABSTRACT

A coupler for a backhoe or other excavator includes a frame including an upper portion and a lower portion. The upper portion is adapted to be secured to an associated backhoe or excavator arm. The lower portion includes a first hook adapted to mate releasably with a first associated attachment pin and includes a second hook adapted to mate releasably with a second associated attachment pin. First and second safety locks are movably connected to the frame and move relative to the first hook between an engaged position for capturing the first associated attachment pin in the first hook and a disengaged position for releasing the first associated attachment pin from the first hook. An actuator is adapted to move the safety locks selectively between the engaged and disengaged positions. First and second safety cams are provided and comprise respective cam profiles that respectively: (i) block movement of the first and second safety locks from their engaged positions to their disengaged positions when the frame and first and second safety cams are arranged in a first angular orientation relative to each other; and, (ii) allow movement of the first and second safety locks from their engaged positions to their disengaged positions when the frame and first and second safety locks are arranged in a second angular orientation relative to each other.

17 Claims, 9 Drawing Sheets

COUPLER WITH SAFETY CAM

CROSS-REFERENCE TO RELATED APPLICATION

This application claims priority from and benefit of the filing date of U.S. Provisional Application Ser. No. 61/143,366 filed Jan. 8, 2009, and the entire disclosure of said provisional application is hereby expressly incorporated by reference into the present specification.

BACKGROUND

Couplers are known for securing construction attachments such as buckets, impact hammers, shears, etc. fixedly and operatively to the distal end of an arm of a tractor, backhoe, excavator or other type of arm-equipped construction/agricultural equipment (any such tractor, backhoe, excavator or the like is referred to herein as an "excavator"). As is generally known, these couplers, also referred to as "quick couplers," are used as an alternative to a pin-on connection for fixedly and operatively securing an associated attachment to the distal end of an arm which is, in turn, secured to a boom of a construction/agricultural machine such as a backhoe or other excavator. Over the years, the safety of such couplers has been greatly improved with respect to minimizing the chance for equipment failure and/or operator error leading to accidental decoupling of the associated attachment, and the present development is directed to a coupler with new and improved safety features.

SUMMARY

In accordance with one aspect of the present development, an attachment coupler comprises a frame including an upper portion and a lower portion. The upper portion is adapted to be secured to an associated arm and the lower portion includes a first hook adapted to receive a first associated attachment pin and a second hook adapted to receive a second associated attachment pin. A first safety lock is movably connected to the frame and is movable relative to the first hook between an engaged position where the first safety lock obstructs the first hook and a disengaged position where the first safety lock is retracted relative to the first hook. An actuator is adapted to move the first safety lock selectively between its engaged and disengaged positions. A first safety cam is movably connected to the frame and comprising a first cam profile that: (i) blocks movement of the first safety lock from its engaged position to its disengaged position when the frame and first safety cam are arranged in a first angular orientation relative to each other; and, (ii) allows movement of the first safety lock from its engaged position to its disengaged position when the frame and first safety lock are arranged in a second angular orientation relative to each other.

In accordance with another aspect of the present development, an attachment coupler comprises a frame including a first hook adapted to mate with a first associated attachment pin and a second hook adapted to mate with a second associated attachment pin. The second hook is movable toward and away from the first hook. A safety lock is movably connected to the frame and moves relative to the first hook between an engaged position where it obstructs the first hook and a disengaged position where it opens the first hook. An actuator is operably connected between the second hook and the safety lock. The actuator is adapted to move the second hook toward and away from the first hook and is adapted to move the safety lock between its engaged and disengaged positions. A safety cam is located adjacent the safety lock and comprises a cam profile that: (i) blocks movement of the safety lock from its engaged position to its disengaged position when the frame is located in a first angular orientation relative to the safety cam; and, (ii) allows movement of the safety lock from its engaged position to its disengaged position when the frame is located in a second angular orientation relative to the safety cam.

In accordance with another aspect of the present development, an attachment coupling system comprises a frame including a first hook adapted to mate with a first associated attachment pin and a second hook adapted to mate with a second associated attachment pin. The frame is pivotally connected to an arm. A safety lock is movably connected to the frame and moves relative to the first hook between an engaged position where it obstructs the first hook and a disengaged position where it opens the first hook. An actuator is operably connected to the safety lock and is adapted to move the safety lock between its engaged and disengaged positions. A safety cam is positioned adjacent the safety lock and is fixed in position relative to the arm. The safety cam includes a cam profile that: (i) blocks movement of the safety lock from its engaged position to its disengaged position when the frame is located in a first angular orientation relative to the arm; and, (ii) allows movement of the safety lock from its engaged position to its disengaged position when the frame is located in a second angular orientation relative to the arm.

DETAILED DESCRIPTION

Referring first to FIGS. 1-5, the coupler 10 comprises a frame F comprising an upper portion UP adapted to be secured to the associated excavator "dipper-stick" or arm A and control link K (FIG. 5), and a lower portion LP connected to the upper portion UP and adapted to be releasably coupled to a bucket or other associated attachment AT (FIG. 5) having first and second parallel, spaced-apart attachment pins P1,P2. As used herein, the term "excavator" is intended to mean an excavator, tractor-loader-backhoe or any other machine having an arm A and control link K to which the coupler 10 can be operatively and pivotally connected as described herein. The upper portion UP of the coupler comprises first and second parallel, spaced-part upper ribs 12,14 comprising respective first apertures 12*a*,14*a* and second apertures 12*b*, 14*b* respectively aligned with each other and centered on respective pin-on axes X1,X2. The coupler 10 is adapted to receive the excavator arm A and excavator control link K in the channel H defined between the upper ribs 12,14, with the excavator arm A pivotally secured to the coupler 10 by a first excavator pin N1 (FIG. 5) received through the excavator arm and the aligned first apertures 12*a*,14*a* of ribs 12,14, and with the excavator control link K pivotally secured to the coupler 10 by a second excavator pin N2 received through the excavator control link K and the aligned second apertures 12*b*,14*b* of the ribs 12,14. The ribs 12,14 can be one-piece or multi-piece components defined from steel castings and/or plates or the like.

Figure 5:
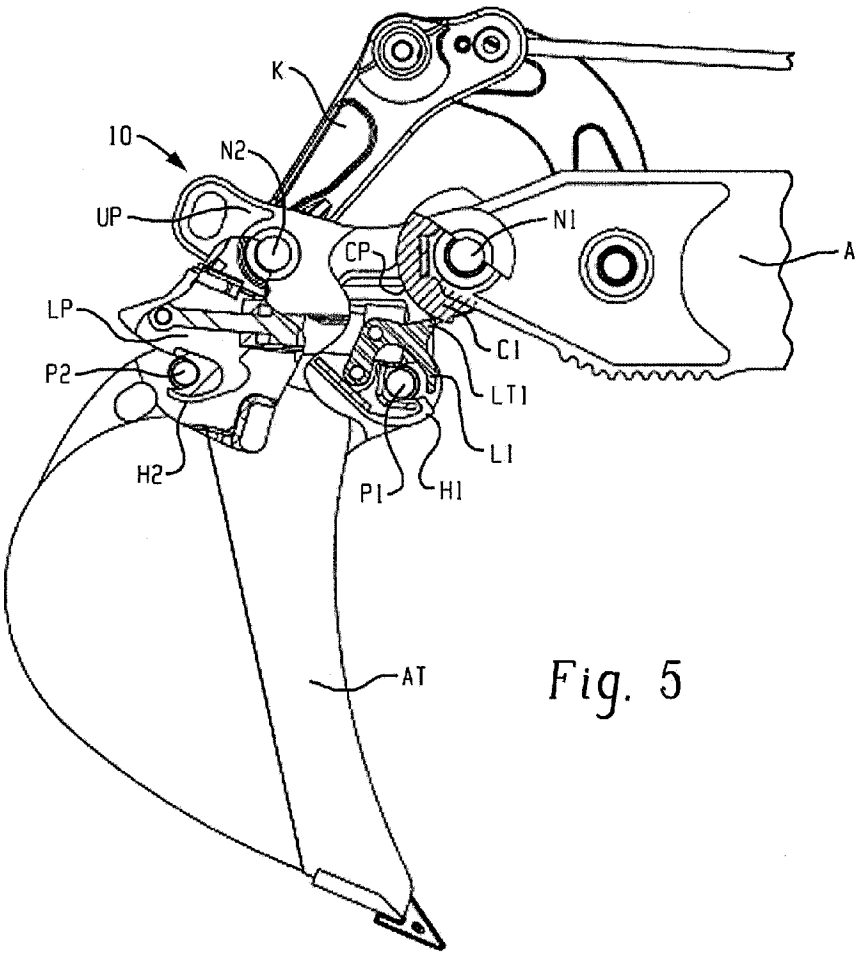
FIG. 5 is a side view that shows the coupler operatively connected to the arm and control link of an associated excavator, and showing the coupler operatively coupled to an associated attachment (bucket) for performing work, wherein portions of both the coupler and bucket are broken away to reveal underlying components.

The lower portion LP of the coupler 10 is adapted to be releasably coupled to or mated with a bucket or other associated attachment AT that includes parallel, spaced-apart first and second attachment pins P1,P2 (see FIG. 5). The lower coupler portion LP comprises a first hook assembly H1 comprising a first (or front or main) open recess or hook FH adapted to receive and retain the first attachment pin P1. The lower coupler portion LP further comprises a second hook assembly H2 comprising a second (or rear or link) open recess or hook SH adapted to receive and retain the second attachment pin P2. The first and second hooks FH,SH open outwardly away from each other in opposite directions. The first hook assembly H1 is fixed in position relative to the upper portion UP, while the second hook assembly H2 is movable as described further below. As such, the first hook FH is fixed in position relative to the first and second pin-on axes X1,X2 of the upper portion UP, and the second hook SH is movable relative to the first hook FH and also relative to the first and second pin-on axes X1,X2. The first and second hook assemblies H1,H2 can be one-piece or multi-piece components defined from steel castings and/or plates or the like.

Figure 6:
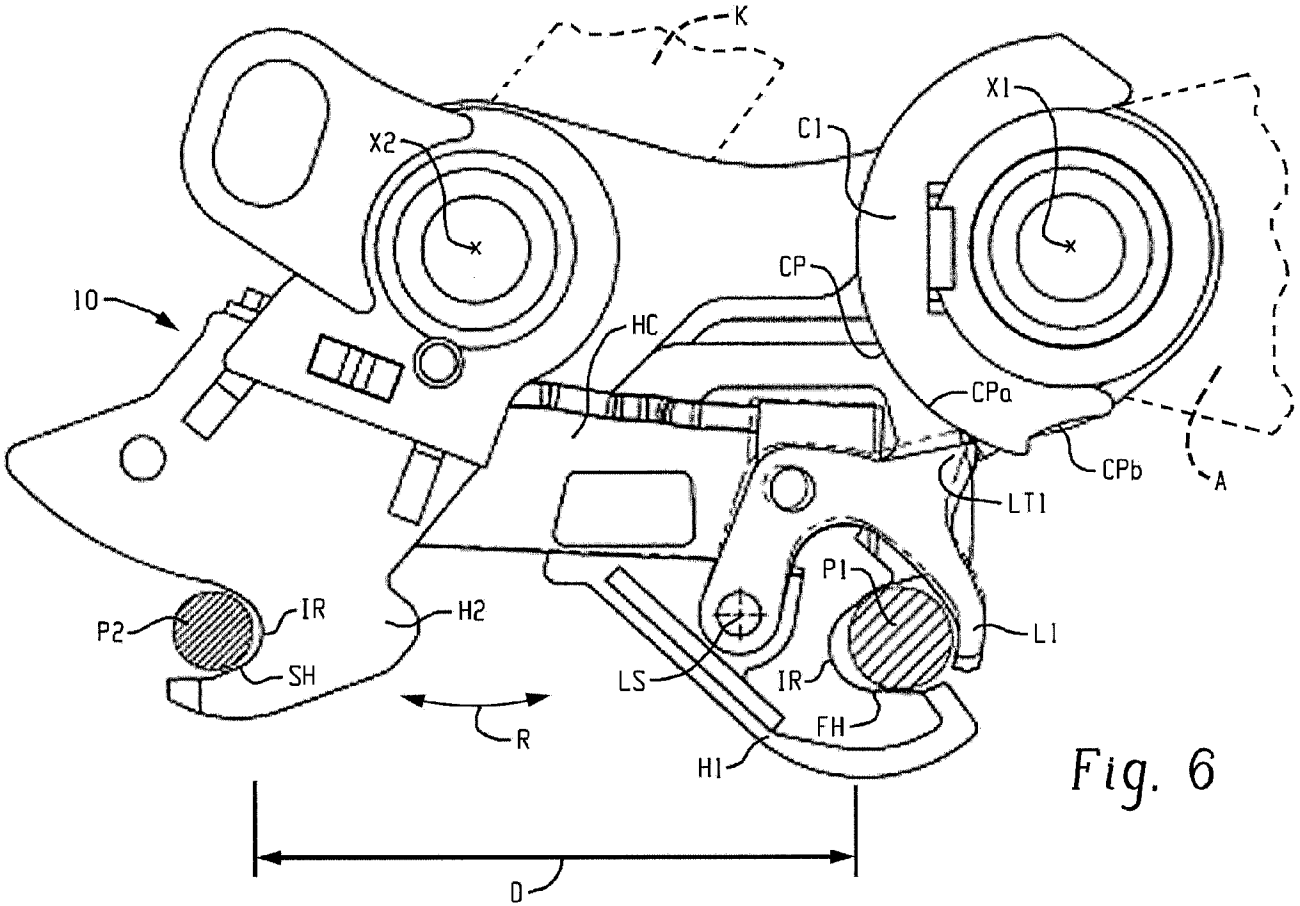
FIG. 6 is a side view that shows the coupler operatively coupled to first and second pins of an associated attachment (the attachment is not shown), with the coupler in a locked condition and with the coupler located at a first angular position relative to its safety cams (and the associated excavator arm) where the safety lock cannot be opened/unlocked (the first upper rib 12 and portions of the first hook assembly H1 are removed from FIG. 6 to reveal internal components)
Figure 7:
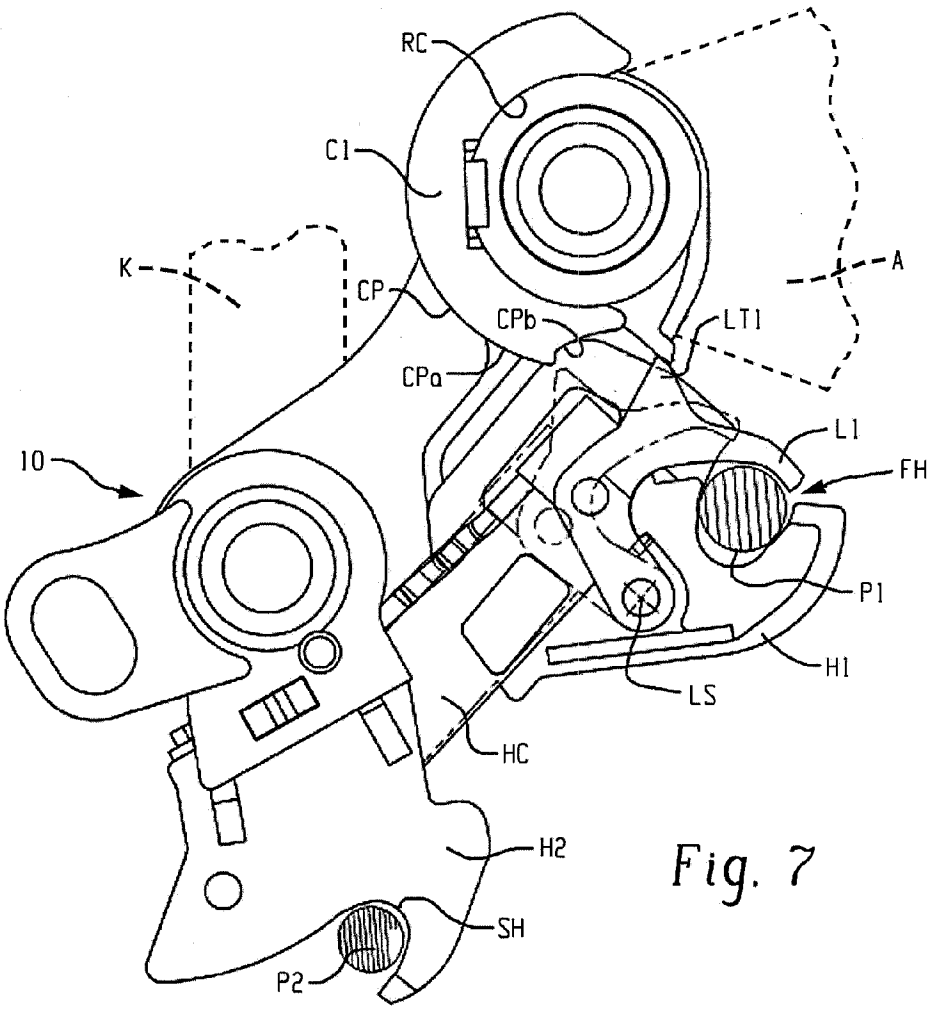
FIG. 7 is similar to FIG. 6, but shows the coupler located at a second angular position relative to its safety cams (and the associated excavator arm) where the safety locks can moved between their closed/locked positions (shown in solid lines) and their opened/unlocked positions (shown in phantom lines)
Figure 8:
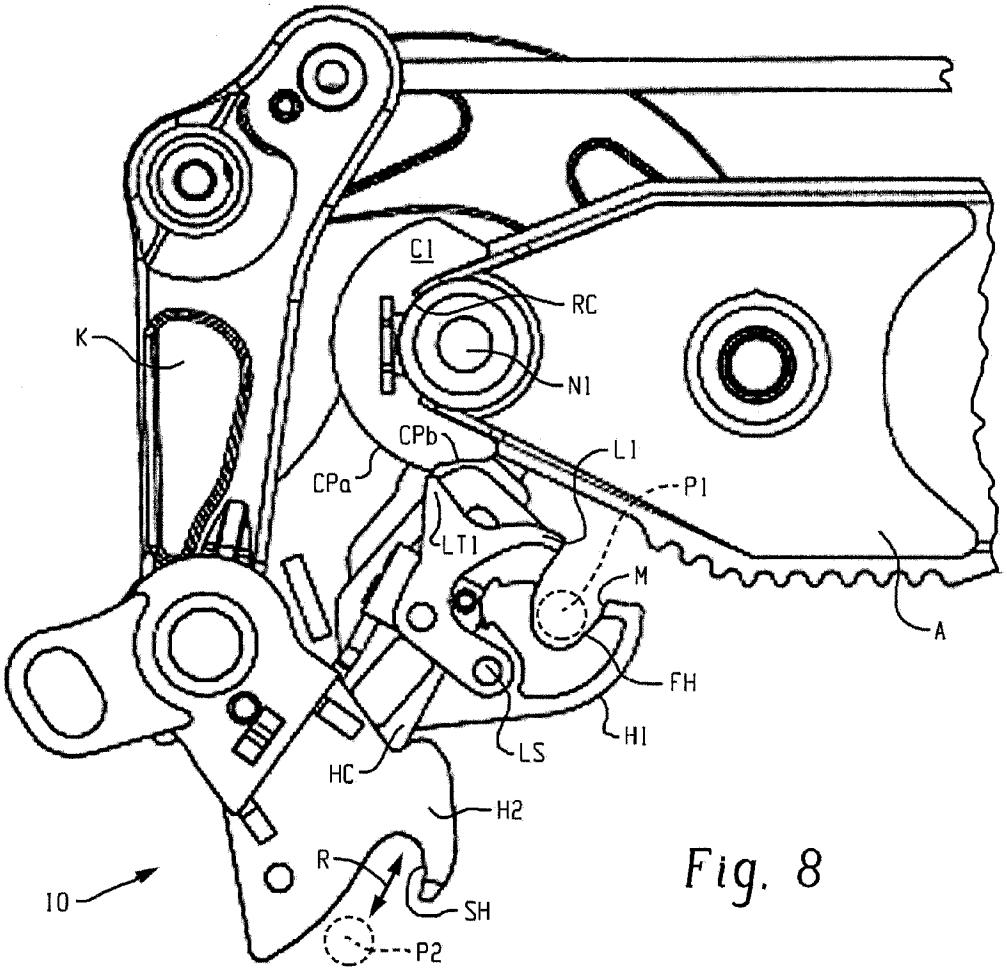
FIG. 8 shows the coupler in the second angular position relative to its safety cams and in its retracted/collapsed and unlocked condition for coupling/decoupling operations (the first upper rib 12 and portions of the first hook assembly H1 are removed from FIG. 8 to reveal internal components)

The coupler 10 further comprises a lock assembly or lock system including one or more safety locks L1 and L2 that are movably connected to the coupler frame F and that move relative to the first hook FH between an engaged position (FIGS. 1 & 3) and a disengaged position (FIG. 8). In the illustrated embodiment, the first and second safety locks L1,L2 are located respectively adjacent opposite first and second lateral sides of the first hook FH and are pivotally connected to the first hook assembly H1. As shown herein, the first and second safety locks L1,L2 are interconnected by a cross plate XL and, thus, can alternatively be considered as a single safety lock. In the illustrated example, the safety locks L1,L2 are pivotally connected to the first hook assembly H1 by respective pivot shafts LS. In the engaged position, the safety locks L1,L2 are extended and obstruct, i.e., at least partially and preferably substantially completely block, an open mouth M of the first hook FH to prevent escape of the first attachment pin P1 from the first hook FH. Thus, in the engaged position, the safety locks L1,L2 capture the first attachment pin P1 in the first hook FH as shown in FIGS. 5-7. In the disengaged position shown in FIG. 8, the safety locks L1,L2 are retracted relative to open the mouth M of the first hook FH sufficiently to open the first hook FH and allow insertion and removal/release of the first attachment pin P1 relative to the first hook FH.

The second hook assembly H2 comprising the second hook SH is movably connected to the upper portion UP or other part of the frame F and moves selectively toward and away from the first hook assembly H1. In the illustrated embodiment, the second hook assembly H2 is pivotally connected to the frame upper portion UP and pivots on an arc R (see FIG. 6) about the second pin-on axis X2 that is coaxial with the second excavator pin N2. In particular, the second hook assembly H2 includes first and second ears HE1,HE2 that are rotatably mounted on bosses that extend inward from the first and second upper ribs 12,14, coaxially with the second pin-on axis X2 and the second apertures 12*b*,14*b*. As such, a distance or spacing D (FIG. 6) between the respective innermost regions IR of the first and second hooks FH,SH is variable depending upon the position of the second hook assembly H2 on the arc R (compare FIGS. 6 & 8).

Figure 1:
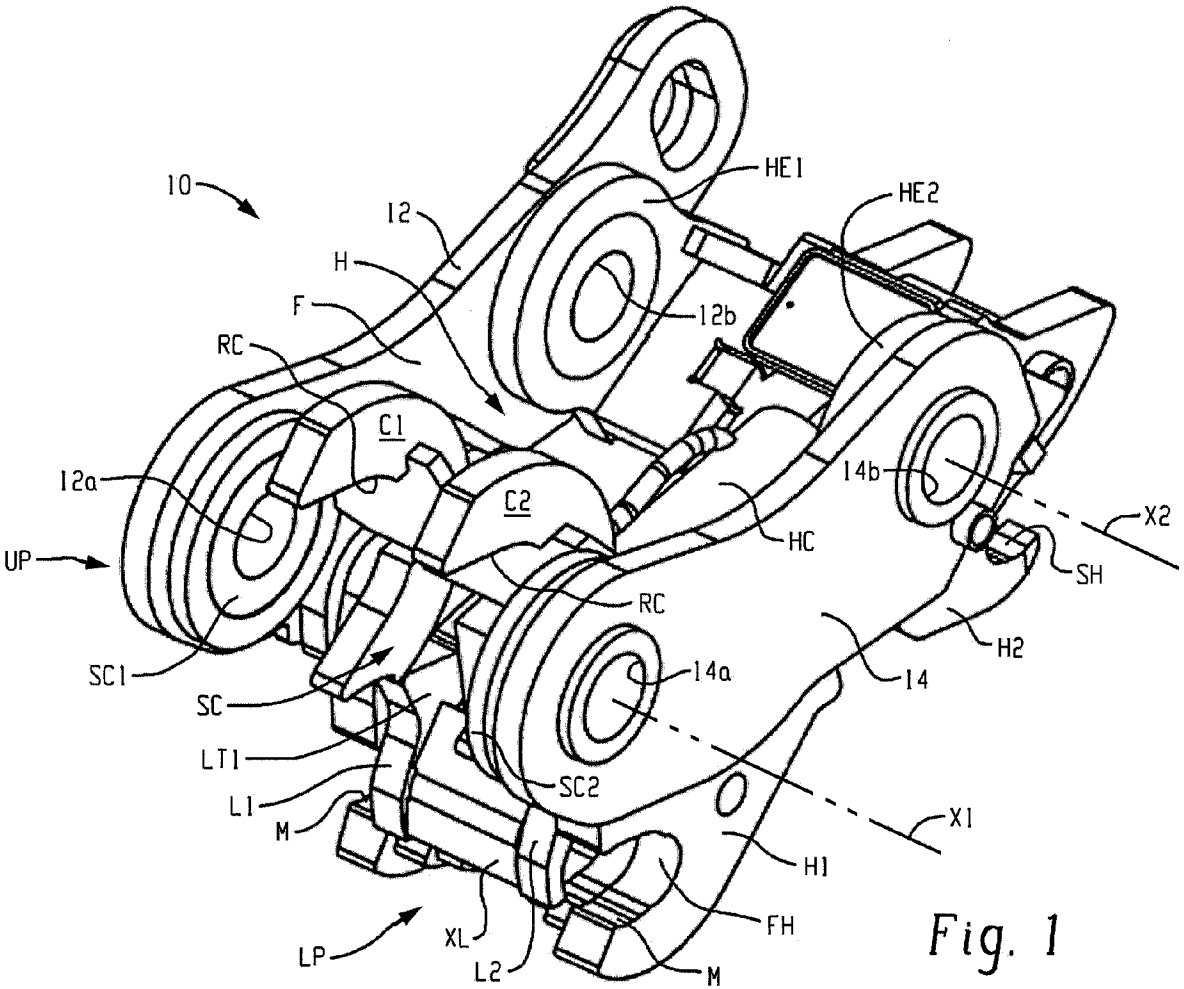
FIGS. 1, 2, and 3 are isometric views of a coupler formed in accordance with the present development, with portions of the coupler broken away in FIG. 3 to reveal underlying components.
Figure 2:
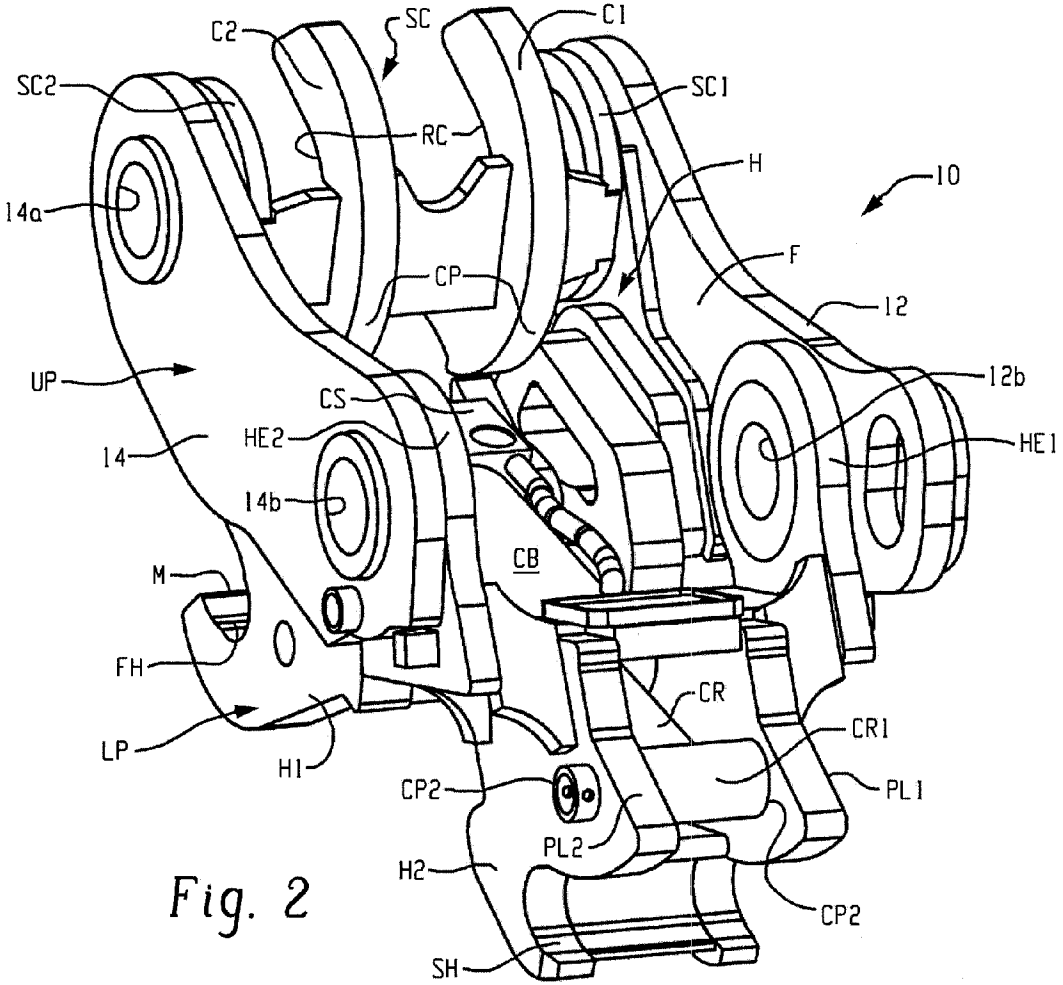
Figure 3:
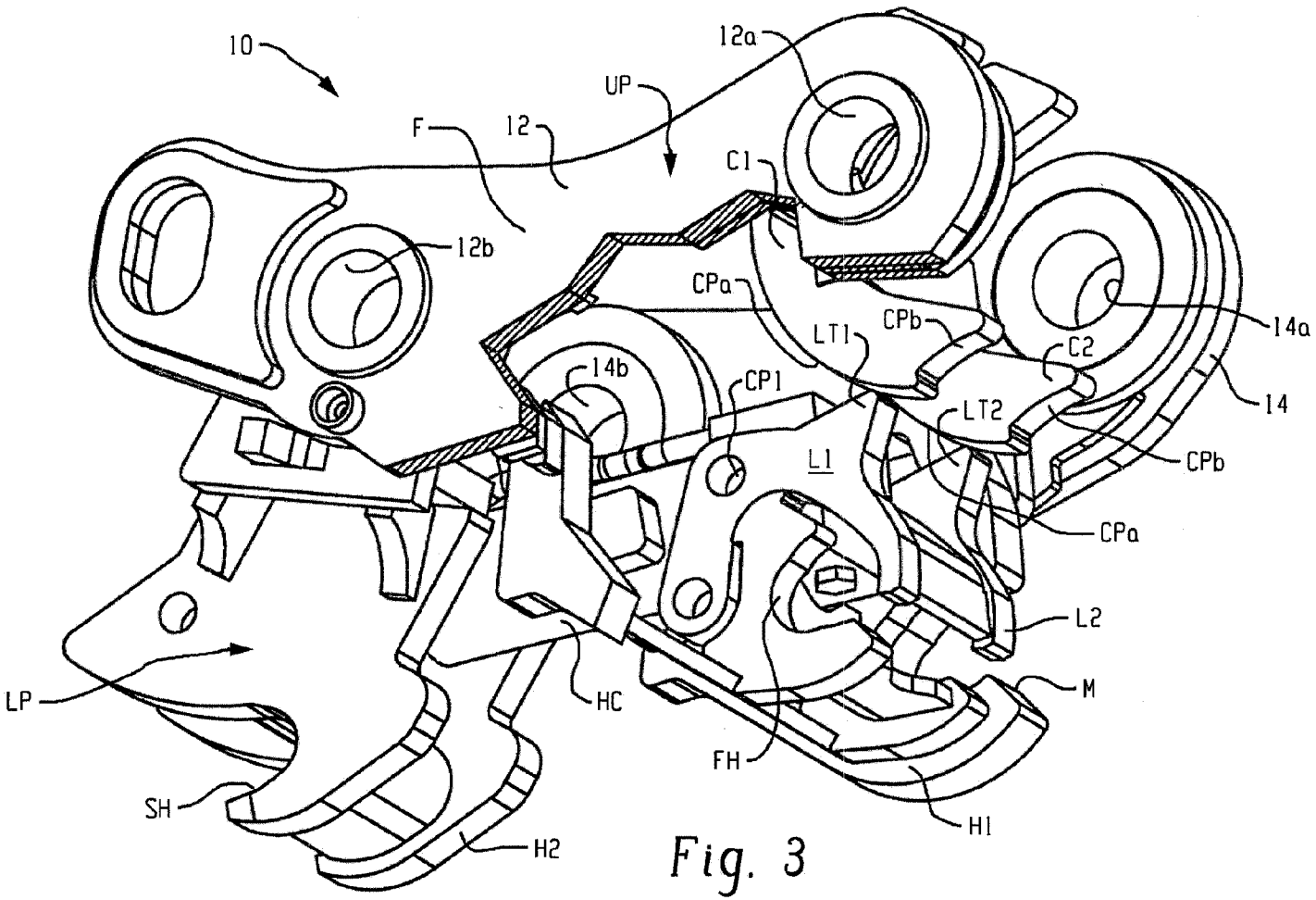
Figure 4:
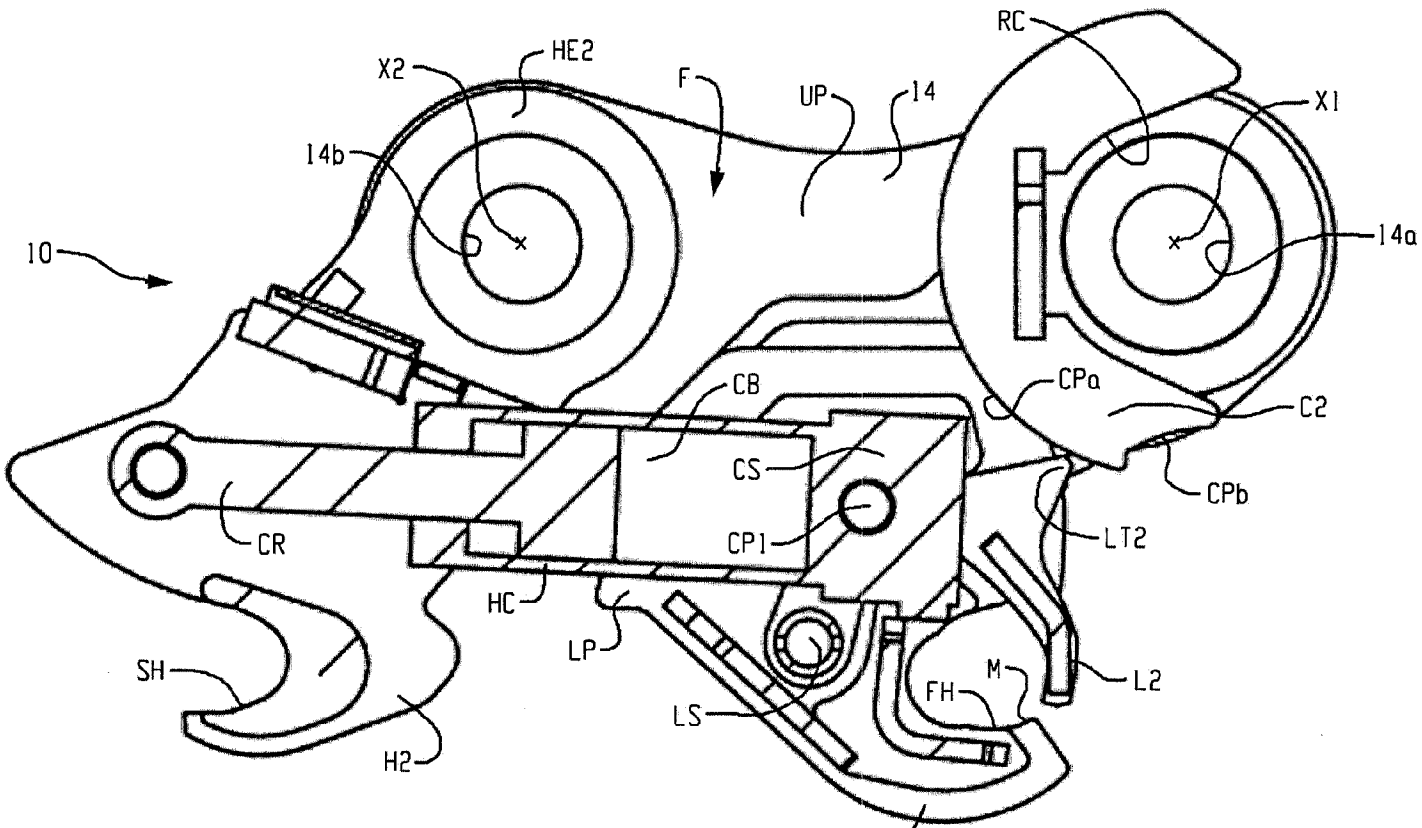
FIG. 4 is a section view taken along the longitudinal axis of the coupler of FIGS. 1-3.

An actuator is provided to selectively move the second hook assembly H2 on the arc R toward and away from the first hook assembly H1 and to control the position of the safety locks L1,L2. In the illustrated embodiment, the actuator comprises a double-acting hydraulic cylinder HC operably connected between the safety locks L1,L2 and the second hook assembly H2. Alternatively, the actuator can be a hydraulically driven or manually driven screw jack assembly or other selectively extensible and retractable structure. Referring specifically to FIG. 4, the illustrated hydraulic cylinder HC comprises a cylinder body CB including a base CS, and a rod CR that is selectively extensible from and selectively retractable into the cylinder body CB under force of hydraulic fluid acting on a piston contained in the body CB. The cylinder base CS is located between and is pivotally connected to the first and second safety locks L1,L2 at respective cylinder connection points CP1 (or is connected to the single first or second safety lock L1,L2 if only one is provided). The cylinder rod CR is operatively connected to the movable second hook assembly H2. For example, as shown in FIG. 2, the cylinder rod CR includes a rod eye CR1 sandwiched between first and second plates PL1,PL2 of the second hook assembly H2 and pivotally connected to respective rod connection points CP2 thereof. As such, when the hydraulic cylinder HC is pressurized to extend the cylinder rod CR (or when an alternative actuator is operated to extend in a corresponding manner), the actuator HC pivots the second hook assembly H2 on the arc R away from the first hook assembly H1 to an extended position and the actuator HC also pivots the safety locks L1,L2 to their engaged or locked positions. Conversely, when the hydraulic cylinder HC is pressurized to retract the cylinder rod CR (or when an alternative actuator is operated to retract in a corresponding manner), the second hook assembly H2 pivots on the arc R toward the first hook assembly H1 to a retracted/collapsed position and the safety locks L1,L2 pivot to their disengaged or unlocked positions.

To prevent accidental or unintentional movement of the safety locks L1,L2 (or single safety lock L1 or L2 if only one is provided) from the engaged/locked position to the disengaged/unlocked position, the coupler 10 further comprises first and second safety cams C1,C2 connected to the frame F and respectively corresponding to and respectively associated with and located adjacent the first and second safety locks L1,L2 (if only one safety lock L1,L2 is provided, only one corresponding cam C1,C2 need be provided). As shown herein, the first and second safety cams C1,C2 are connected together as a unitary safety cam assembly SC, but they need not be. The first and second safety cams C1,C2 are located in the frame channel H, between the first and second upper ribs 12,14 and are aligned respectively with the first and second safety locks L1,L2. More particularly, the first and second safety locks comprise respective first and second projections or tabs LT1,LT2, and the first and second safety cams C1,C2 are respectively aligned with the first and second safety lock tabs LT1,LT2.

The first and second safety cams C1,C2 are movably connected to the frame F. In particular, the first and second safety cams C1,C2 are pivotable/rotatable about the first pin-on axis X1 relative to the frame. As shown herein, the safety cam assembly SC includes first and second ears SC1,SC2 that are rotatably mounted on respective bosses that project into the frame channel H from the respective first and second upper ribs 12,14. The first and second safety cam ears SC1,SC2 include respective apertures such that the first excavator pin N1 extends there through when used to pivotally connect the frame F to an associated excavator arm A (see FIGS. 5-8). When the frame is operatively and pivotally connected to the associated excavator arm A as shown, each safety cam C1,C2 is fixed in position relative to the arm A, by engagement of the arm A with each safety cam C1,C2 and/or by engagement of the arm A with any other portion of the safety cam assembly SC. In the illustrated embodiment, the first and second safety cams C1,C2 each include a concave recess RC into which a tip of the excavator arm A is received when the coupler frame F is operatively connected to the excavator arm A using the first excavator pin N1 inserted through the first apertures 12*a*,14*a* along the first pin-on axis X1, such that the first and second safety cams C1,C2 are fixedly secured in position relative to the arm A. As such, pivoting movement of the coupler frame F about the first pin-on axis X1 alters the angular orientation or relationship between the frame F and the first and second safety cams C1,C2.

The first and second safety cams comprise respective profiles CP that: (i) block movement of the corresponding associated safety lock L1,L2 from the engaged position to the disengaged position (or from the disengaged position to the engaged position) when the frame F and safety cams C1,C2 are in a first angular position or orientation relative to each other; and (ii) allow movement of the corresponding associated safety lock L1,L2 from the engaged position to the disengaged position (or from the disengaged position to the engaged position) when the frame F and safety cams C1,C2 are in a second angular position or orientation relative to each other.

As shown in FIGS. 4-6, when the coupler frame F is in a first angular position relative to the safety cams C1,C2, the safety lock tabs LT1,LT2 are aligned with and will abut a first, more prominent portion CPa of the safety cam profile CP of the respective safety cams C1,C2 upon attempted movement of the safety locks L1,L2 from the engaged position to the disengaged position (or from the disengaged position to the engaged position). Preferably, this first angular position of the frame F corresponds to all angular positions of the frame F on the arm A, except when the frame F is in the fully curled or crowded position relative to the arm A. As shown in FIGS. 7 & 8, the fully curled or crowded position occurs when the frame F is rotated substantially fully inward to a position where the first hook FH is tucked under the aim A and opens in a generally upward direction instead of a sideways or downward direction. As such, in the fully curled/crowded position, a first associated attachment pin P1 seated in the first hook FH will be retained therein by gravity even if the safety locks L1,L2 are disengaged/unlocked.

As shown in FIGS. 7 & 8, when the coupler frame F is fully curled/crowded relative to the associated excavator arm A such that the frame F is in a second angular position relative to the safety cams C1,C2, the safety lock projections LT1,LT2 are aligned with and will move freely past a second, less prominent portion CPb of the safety cam profile CP of the respective safety cams C1,C2 upon attempted movement of the safety locks L1,L2 from the engaged position to the disengaged position (or from the disengaged position to the engaged position).

Those of ordinary skill in the art will recognize that operation of the coupler 10 to pick-up an attachment includes:

- beginning with the coupler frame F in the position as shown in FIG. 8 (once the safety locks L1,L2 are disengaged as shown, the coupler frame F can be rotated relative to the arm A to any desired position);
- rotating/maneuvering the coupler frame F so that the first attachment pin P1 is received in the first hook FH;
- rotating/maneuvering the coupler frame F to the fully curled/crowded position to align the second hook SH with the second attachment pin P2 (FIG. 8);
- operating the actuator HC to move the second hook assembly H2 away from the first hook assembly H1 along the arc R until the second attachment pin P2 is fully seated in the second hook SH and so that the safety locks L1,L2 move from their disengaged positions (FIG. 7, phantom lines) to their engaged positions (FIG. 7, solid lines) so that the associated attachment AT including the pins P1,P2 is fully operatively coupled to the coupler frame F.

To decouple the attachment, the attachment AT is moved to a safe decoupling position (close to the ground or other safe support surface) and:

- the coupler frame F is rotated relative to the excavator arm A to the fully curled/crowded position shown in FIGS. 7 & 8;
- with the attachment AT safely supported on the ground or other surface, the actuator HC is operated to arrange the coupler 10 as shown in FIG. 8, where: (i) the second hook assembly H2 is retracted toward the first hook assembly H1 to disengage the second attachment pin P2 from the second hook SH; and (ii) the first and second safety locks L1,L2 are moved from their engaged positions to their disengaged positions to open the mouth M of the first hook FH;
- the coupler frame F is then rotated/maneuvered as needed to separate the first hook FH from the first attachment pin P1.

Figure 9B:
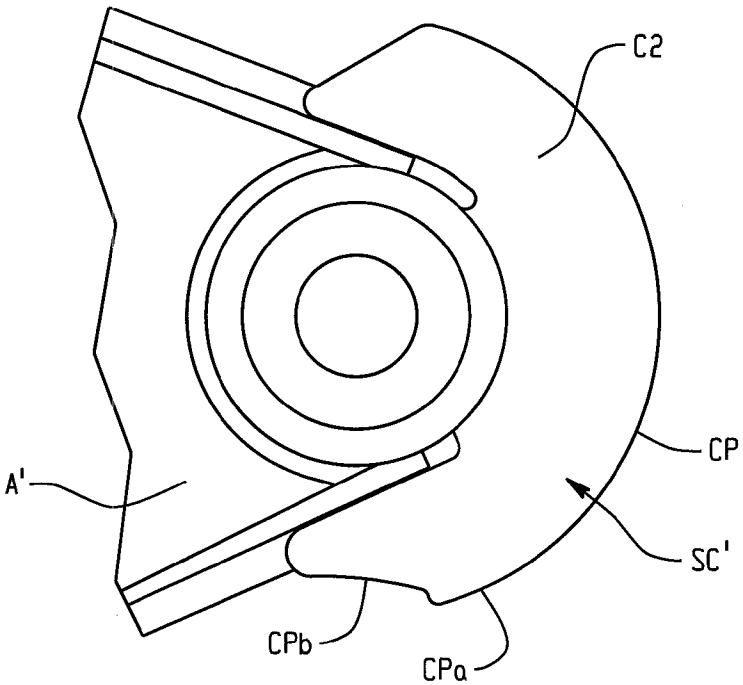
FIGS. 9A and 9B are left and right side views of an arm for an excavator including first and second safety cams connected thereto or formed as a part thereof.
Figure 9A:
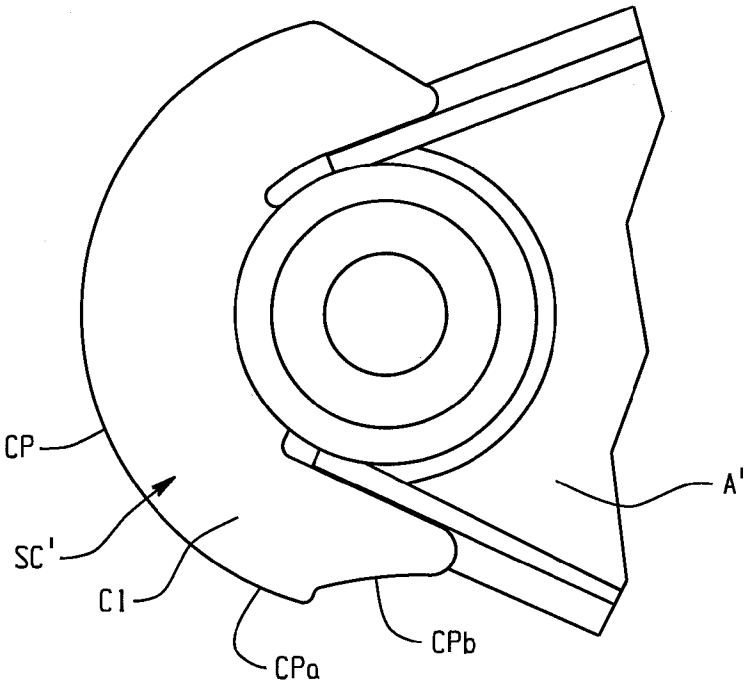

As shown herein, the safety cams C1,C2 are connected to the coupler frame F and are engaged by the associated excavator arm A only when the coupler 10 is connected to the min. In an alternative embodiment as shown in FIGS. 9A and 9B, the safety cam(s) C1,C2 are defined as part of and/or connected to the associated excavator arm A to define an arm A', so as to be separate from coupler frame F but still positioned to lie adjacent the first and second safety locks L1,L2 when the coupler frame F is operatively connected to the associated arm A'. The safety cams C1,C2 can be separately connected to or defined as part of the arm A to define the A', or the safety cams C1,C2 can be defined as a sub-assembly that is connected to the arm A to define the arm A', The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An attachment coupler comprising:

a frame including an upper portion and a lower portion, said upper portion adapted to be secured to an associated arm and said lower portion comprising a first hook adapted to receive a first associated attachment pin and comprising a second hook adapted to receive a second associated attachment pin;

a first safety lock movably connected to the frame and movable relative to the first hook between an engaged position where the first safety lock obstructs the first hook and a disengaged position where the first safety lock is retracted relative to the first hook;

an actuator adapted to move the first safety lock selectively between its engaged and disengaged positions;

a first safety cam movably connected to the frame and comprising a first cam profile that: (i) blocks movement of the first safety lock from its engaged position to its disengaged position when the frame and first safety cam are arranged in a first angular orientation relative to each other; and, (ii) allows movement of the first safety lock from its engaged position to its disengaged position when the frame and first safety lock are arranged in a second angular orientation relative to each other;

said first safety cam comprising a recess adapted to receive a tip of the associated arm for fixing a position of the first safety cam relative to the associated arm.

2. The coupler as set forth in claim 1, wherein said first hook is part of a first hook assembly and said second hook is part of a second hook assembly that is selectively movable by said actuator relative to said first hook assembly to control a spacing between said first and second hooks.

3. The coupler as set forth in claim 2, wherein said actuator is operably connected between said first safety lock and said second hook assembly such that said first safety lock moves from said disengaged position to said engaged position when said actuator is operative to move said second hook assembly away from said first hook assembly, and such that said first safety lock moves from said engaged position to said disengaged position when said actuator is operative to move said second hook assembly toward said first hook assembly.

4. The coupler as set forth in claim 3, wherein said first and second hooks open in opposite directions as compared to each other.

5. The coupler as set forth in claim 3, further comprising a second safety lock movably connected to the frame and movable relative to the first hook between an engaged position where the second safety lock obstructs the first hook and a disengaged position where the second safety lock is retracted relative to the first hook, wherein said first safety lock and said second safety lock are both connected to said actuator.

6. The coupler as set forth in claim 5, wherein said actuator comprises a hydraulic cylinder including a body and a rod that is selectively extensible from and retractable into said body by hydraulic pressure, said body including a portion located between and connected to both said first and second safety locks, and said rod connected to said second hook assembly.

7. The coupler as set forth in claim 5, further comprising:

a second safety cam movably connected to the frame and comprising a second cam profile that: (i) blocks movement of the second safety lock from its engaged position to its disengaged position when the frame and second safety cam are arranged in said first angular orientation relative to each other; and, (ii) allows movement of the second safety lock from its engaged position to its disengaged position when the frame and second safety lock are arranged in said second angular orientation relative to each other;

said second safety cam comprising a recess adapted to receive the tip of the associated arm for fixing the position of the second safety cam relative to the associated arm.

8. The coupler as set forth in claim 7, wherein said first and second safety cams are interconnected to define a safety cam assembly that is adapted for being fixedly secured to the associated arm by engagement of the associated arm with the respective recesses of the first and second safety cams.

9. The coupler as set forth in claim 8, wherein said safety cam assembly is pivotally connected to the frame.

10. The coupler as set forth in claim 9, wherein said first and second safety locks are pivotally connected to said frame and pivot between their respective engaged and disengaged positions.

11. The coupler as set forth in claim 1, wherein said upper portion of said frame comprises first and second parallel spaced-apart ribs each comprising first and second apertures that are respectively aligned with each other along respective first and second pin-on axes, and wherein said first hook assembly is fixed in position relative to said upper portion and said second hook assembly is movable relative to said upper portion and said first hook assembly.

12. An attachment coupler comprising:

a frame including an upper portion and a lower portion, said upper portion adapted to be secured to an associated arm and said lower portion comprising a first hook adapted to receive a first associated attachment pin and comprising a second hook adapted to receive a second associated attachment pin, wherein said upper portion of said frame comprises first and second parallel spaced-apart ribs each comprising first and second apertures that are respectively aligned with each other along respective first and second pin-on axes, and wherein said first hook is fixed in position relative to said upper portion and said second hook is movable relative to said upper portion and said first hook;

a safety lock movably connected to the frame and movable relative to the first hook between an engaged position where the safety lock obstructs the first hook and a disengaged position where the safety lock is retracted relative to the first hook;

an actuator adapted to move the safety lock selectively between its engaged and disengaged positions;

a safety cam movably connected to the frame and comprising a cam profile that: (i) blocks movement of the safety lock from its engaged position to its disengaged position when the frame and safety cam are arranged in a first angular orientation relative to each other; and, (ii) allows movement of the safety lock from its engaged position to its disengaged position when the frame and safety cam are arranged in a second angular orientation relative to each other, wherein:

said safety cam rotates about said first pin-on axis; and, said second hook rotates about said second pin-on axis.

13. An attachment coupler comprising:

a frame comprising first and second spaced-apart ribs each comprising first and second apertures that are respectively aligned with each other on respective first and second pin-on axes, said frame further including a first hook connected to said first and second ribs and adapted to engage a first associated attachment pin and said frame further including a second hook adapted to engage a second associated attachment pin, said second hook being movable toward and away from said first hook;

a safety lock movably connected to the frame and movable relative to the first hook between an engaged position where it obstructs said first hook and a disengaged position where it opens said first hook;

an actuator operably connected between said second hook and said safety lock, said actuator adapted to move the second hook toward and away from the first hook and adapted to move the safety lock between its engaged and disengaged positions;

a safety cam connected to the frame between the first and second ribs adjacent the safety lock and adapted to be engaged by and fixed in position relative to an associated machine arm, said frame rotatable relative to said safety cam about said first pin-on axis, said safety cam comprising a cam profile that: (i) blocks movement of the safety lock from its engaged position to its disengaged position when the frame is located in a first angular orientation relative to the safety cam; and, (ii) allows movement of the safety lock from its engaged position to its disengaged position when the frame is located in a second angular orientation relative to the safety cam.

14. An attachment coupling system comprising:

a frame including a first hook adapted to mate with a first associated attachment pin and including a second hook adapted to mate with a second associated attachment pin, said frame pivotally connected to an excavator arm;

a safety lock movably connected to the frame and movable relative to the first hook between an engaged position where it obstructs said first hook and a disengaged position where it opens said first hook;

an actuator operably connected to said safety lock and adapted to move the safety lock between its engaged and disengaged positions;

a safety cam connected to and fixed in position relative to the excavator arm and positioned adjacent the safety lock, said safety cam comprising a cam profile that: (i) blocks movement of the safety lock from its engaged position to its disengaged position when the frame is located in a first angular orientation relative to said arm and relative to said safety cam; and, (ii) allows movement of the safety lock from its engaged position to its disengaged position when the frame is located in a second angular orientation relative to said arm and relative to said safety cam.

15. The attachment coupling system as set forth in claim 14, wherein said safety cam is pivotally connected to said frame.

16. The attachment coupling system as set forth in claim 15, wherein said frame includes an upper portion and a lower portion, said upper portion secured to the excavator arm and said lower portion comprising said first and second hooks, wherein said upper portion of said frame comprises first and second parallel spaced-apart ribs each comprising first and second apertures that are respectively aligned with each other along respective first and second pin-on axes, and wherein said first hook is fixed in position relative to said upper portion and said second hook is movable relative to said upper portion and said first hook assembly;

wherein:

said frame rotates relative to said safety cam about said first pin-on axis; and, said second hook assembly rotates relative to said upper portion of said frame about said second pin-on axis.

17. The attachment coupling system as set forth in claim 14, wherein said safety cam comprises a concave recess and wherein said safety cam is engaged with a tip of the excavator arm by receipt of a tip of the excavator arm into said concave recess.

* * * * *